United States Patent [19]

Chaussard

[11] Patent Number: 4,686,018

[45] Date of Patent: Aug. 11, 1987

[54] ORGANIC ELECTROLYSIS CELL WITH SACRIFICIAL ELECTRODE

[75] Inventor: Jacques Chaussard, Paris, France

[73] Assignee: Societe Nationale des Poudres et Explosifs, Paris, France

[21] Appl. No.: 904,025

[22] Filed: Sep. 2, 1986

[30] Foreign Application Priority Data

Sep. 5, 1985 [FR] France ..... 85 13188

[51] Int. Cl.[4] ..... C25C 1/00

[52] U.S. Cl. ..... 204/59 R; 204/260; 204/272; 204/292; 204/293

[58] Field of Search ..... 204/260, 272, 292, 293, 204/59 R

[56] References Cited

U.S. PATENT DOCUMENTS

| | | | |
|---|---|---|---|
| 982,037 | 1/1911 | Crocher | 204/260 |
| 1,278,723 | 9/1918 | Nickle | 204/260 |
| 3,141,841 | 7/1964 | Braithwaite et al. | 204/263 |

*Primary Examiner*—R. L. Andrews

*Attorney, Agent, or Firm*—Burns, Doane, Swecker & Mathis

[57] ABSTRACT

The present invention relates to a cell for the organic electrosynthesis of organic or organometallic compounds, containing two electrodes (2) and (4) of which only one (4) is sacrificed by the electrochemical reaction of which it forms the seat.

The sacrificial electrode (4) consists of at least one solid metal block and is applied under the influence of its own weight against the other electrode (2) from which it is separated by an electrical insulating material (5) which allows the passage of the electrolytic solution (6) and of which the shape and the dimensions enable the active substances of the two electrodes (2) and (4) to remain parallel.

The active surface of the electrode (2) has a constant inclination relative to a direction D (9) forming an angle less than 45 degrees with the vertical on the one hand, and an inclination less than 45 degrees relative to the vertical on the other.

Any straight line in direction D (9) passing through any point on the electrode (4) passes through the active surface of the electrode (2).

16 Claims, 7 Drawing Figures

ORGANIC ELECTROLYSIS CELL WITH SACRIFICIAL ELECTRODE

BACKGROUND AND SUMMARY OF THE INVENTION

The present invention relates to an electrolysis cell for electrosynthesis, in an organic medium, of organic or organometallic compounds, containing two electrodes, one and only one of which is sacrificed during the electrosynthesis by the electrochemical reaction of which it forms the seat.

U.S. Pat. Nos. 3,573,178 and 3,141,841 describe the synthesis of tetraethyl lead in an electrolysis cell containing an anode which consists of lead balls and which is separated from the cylindrical cathode by means of an insulating porous side. Balls are added during the electrolysis to replace those which are consumed. However, the functioning of this device is unsatisfactory for strongly reducing metals such as magnesium, aluminum, zinc and titanium, which are covered with an insulating oxide coat which increases the contact resistance between grains significantly. Moreover, the granular form of these metals is sometimes expensive. Additionally, metallic dusts and slimes are often formed, which interferes with the operation.

South African Pat. No. 6,806,413 describes the synthesis of tetraethyl lead in an electrolysis cell containing a sacrificial anode which is in the form of a metal ribbon which runs between two cathodes in the form of discs. This system has a certain number of disadvantages. The thickness of the anode must especially be small so that the interelectrode distance remains constant; the rate of advance of the anode must therefore be rapid, and, in order to avoid the rupture of the ribbon, the device requires a relatively complicated mechanical system.

Moreover, several mechanical devices, often very complicated, which enable the distance between the electrodes to be adjusted so as to maintain it constant or which enable the worn-out anodes to be replaced, are known. For example, German Pat. No. 2,107,305 describes such a device.

Electrolysis cells containing a sacrificial anode have already been described for the electrosynthesis of oxalic acid from carbon dioxide, with aluminum on the one hand, in Chim. Ind. (Milan) 55. (1973) 156, and with zinc on the other, in J. Appl. Electrochem. 11 (1981) 743, for the electrocarboxylation of ethylene (Tetrahedron Lett. 1973, 3025) and for that of thioethers (German Democratic Republic Pat. No. 203,537).

These cells are without a diaphragm and generally have a coaxial cylindrical symmetry. In some cases, the central electrode functions as the sacrificial anode (for example, metal rod); in other cases, it functions as the cathode (for example, graphite). These laboratory cells do not easily lend themselves to an industrial use, especially in a continuous fashion, because they require frequent and not very convenient renewal of the anode on the one hand, and the distance between the 2 electrodes varies with time on the other.

The object of the present invention is to provide an electrolysis cell suitable for simple continuous industrial use, which has the advantages of the abovementioned industrial cells, viz. especially the maintenance of a constant gap between the electrodes, without having the disadvantages thereof.

The electrolysis cell according to the invention for the electrosynthesis, in an organic medium, of organic or organometallic compounds, containing two electrodes, only one of which is sacrificed during the electrosynthesis by the electrochemical reaction of which it forms the seat, is characterized in that:

the sacrificial electrode consists of at least one solid block of metal and is applied, under the influence of its own weight, against the other electrode from which it is separated by an electrical insulating material which allows the passage of the electrolytic solution and of which the shape and the dimensions enable the active surfaces of the two electrodes to remain parallel during the electro-synthesis, the active surface of the unsacrificial electrode has, in all its points, a constant inclination relative to a direction D forming an angle less than 45 degrees with the vertical on the one hand, and an inclination less than 45 degrees relative to the vertical, on the other, any straight line in the direction D passing through any point of the sacrificial electrode passes through the active surface of the unsacrificial electrode.

The inclination, at a point on the surface, relative to a direction D is normally considered to be the angle formed by the plane tangent to the surface at this point and by the straight line which has the direction D passing through this point.

A direction may be marked by an infinity of parallel straight lines.

Preferably, the direction D relative to which the surface of the unsacrificial electrode has a constant inclination is the vertical direction. In this preferred case, in which the D and the vertical directions are confounded, the angle formed by these two directions is zero.

Any point of the sacrificial electrode means a point situated on the surface of as well as within the solid metal blocks(s) forming this electrode.

The cell according to the invention has many advantages. First of all, it enables a constant and preferably small (less than 5 mm) gap to be maintained between the two electrodes throughout the period of electrolysis, which is very important in an organic medium which is not very conducting, in order to avoid an excessive electricity consumption and an excessive heating by the Joule effect.

As one of the two electrodes being gradually sacrificed during the electrochemical reaction, a means which makes it possible to maintain the distance between the two electrodes constant is necessarily required, and this is obtained within the scope of this invention, by virtue of the particular design and geometry of the cell. Additionally, it should be possible to replace the sacrificial electrode readily as soon as it is completely sacrificed, or preferably, for continuous processes, progressively as it is sacrificed, without stopping and interrupting the electrolysis.

The cell according to the invention enables the sacrificial electrode to be replaced very easily, without stopping the electrolysis by the superimposition of one (or more) other block on the solid metal block(s) which form(s) the sacrificial electrode, which is a considerable advantage when the processes are to be employed continuously. Furthermore, the entire electrode is sacrificed, without waste or loss. The cell according to the invention also makes it possible to use sacrificial electrodes which are solid, and therefore not very bulky for a given mass, and of different shapes. This is of great value from an economic point of view.

Another advantage is the fact that, taking into account the geometry of the cell and especially the inclination of the unsacrificial electrode, ground space requirement is much reduced, which results in a space saving, much appreciable from an economic point of view.

In many cases, the sacrificial electrode is the anode (anodic oxidation) as in the examples which will follow, but sometimes the sacrificial electrode is the cathode as in the case of the electrosynthesis of tetramethyl lead in an acetonitrile medium from methyl bromide using a lead cathode according to HE. Ulery JECS 116, 1201, 1969:

$$4\ CH_3Br + Pb\ (cathode) + 4e \rightarrow (CH_3)_4Pb + 4\ Br.$$

The sacrificial electrode consists of at least one solid metal block. The metal is preferably chosen from the group consisting of magnesium, aluminum, zinc and their alloys, viz. any alloy containing at least one of the three metals mentioned above. Many other metals, such as especially copper, nickel and lead, are also suitable. The choice of the metal depends, among other things, on the compound to be synthesized. In the case of the electrosynthesis of organometallic derivatives, the sacrificial electrode consists, for example, of the corresponding metal or an alloy based on this metal.

In the case of the electrosynthesis of carboxylic acids by the reduction of organic halides in the presence of $CO_2$, magnesium will be preferred. For the electrosynthesis of alcohols by the electrochemical reduction of organic halides in the presence of carboxylated derivatives as well as for the electrosynthesis of ketones and aldehydes by the electrochemical reduction of organic halides in the presence of organic acid anhydrides, a metal chosen from the group consisting of magnesium, zinc, aluminum and their alloys will be preferred.

The solid metal blocks may be, for example, casting ingots of which the cross-section is square, or rectangular, or trapezoidal, or circular, or of any other shape. They may, if required, be machined before use so that their geometry is adapted to that of the unsacrificed electrode. Preferably, but without being of an imperative nature, such a machining is carried out in order to facilitate the start of the electrolysis.

According to a preferred variation, the sacrificial electrode consists of stacked solid metal blocks, each layer of the stacking containing only a single block. According to another variation, at least one layer of the stacking contains several blocks arranged side by side.

The sacrificial electrode is applied under the influence of its own weight, by gravity, against the other, unsacrificial electrode. According to a preferred variation, the sacrificial electrode is applied against the other electrode under the sole influence of its own weight. According to another variation, the sacrificial electrode is applied against the other electrode under the influence, in addition to that of its own weight, of that of an inert load resting on the sacrificial electrode. Preferably, the inert load is an electrical conductor and also serves for ensuring the electricity supply to the sacrificial electrode.

According to another variation, the sacrificial electrode is applied against the other electrode under the influence, in addition to that of its own weight, of the force produced by a spring which is compressed between the upper part of the sacrificial electrode and one side of the cell.

According to another preferred variation, the geometry of the unsacrificial electrode is such that it alone ensures the retention of the sacrificial electrode, i.e. no other side of the cell is used for this purpose. This is the case, for example, when the active surface of the unsacrificial electrode is conical or dihedral. These two preferred variations are described later (FIGS. 1 to 4).

According to another variation, the retention of the sacrificial electrode may also be ensured by the unsacrificial electrode and by an inert side of the cell at the same time. This is the case, for example, when the active surface of the unsacrificial electrode is in the form of a plane surface forming a dihedron with an inert side of the cell. This variation is also described later (FIG. 5).

The unsacrificial electrode is made of a conducting material. Metals such as iron, aluminum and nickel, alloys such as stainless steel, metal oxides such as $PbO_2$ and $NiO_2$, and graphite may be mentioned in a non-limiting way. Preferably it is made of a metal chosen from the group consisting of nickel and stainless steel.

Preferably, the distance between the active surfaces of the two electrodes is less than 5 mm. This distance is typically measured along a common perpendicular, between the two parallel surfaces.

The two electrodes are separated by an electrical insulating material which allows the passage of the electrolytic solution and of which the shape and the dimensions enable the active surfaces of the 2 electrodes to remain parallel during the electrosynthesis. This electrical insulating material must, of course, have a mechanical strength adequate to support the sacrificial electrode which rests on this material.

Preferably, the electrical insulating material is a plastic material in the form of a grid, the thickness of which is less than 5 mm and the meshwork of which consists of two parallel wire networks, these two networks being superimposed, crossed, joined to each other at the points of contact between the wires, the thickness of the wires of each network being the same. In general, the two networks are joined to each other by soldering and the wires of the two networks have the same thickness.

By way of indication, the distance between the wires of each network is between a few millimetres and a few centimetres.

The wires of each network need not be parallel; their thickness does not need to be constant provided that, after assembling the networks, the grid has a constant maximum thickness at several points, less than approximately 5 mm.

The cross-section of the wires can be of any shape, for example square, rectangular, circular, elliptical or trapezoidal.

The plastic material may be made of, for example, polypropylene, polyethylene or polytetrafluoroethylene.

Such plastic grids have a high frequency of gaps, which allows a ready circulation of the electrolytic solution between the two electrodes on the one hand, and a relatively small area of contact with the electrodes, which avoids an excessive drop in their active surface, on the other.

As other materials separating the two electrodes, a cloth, a linen or a porous material of constant thickness such as, for example, a ceramic piece of a felt, may be used, within the scope of the present invention.

The renewal of the electrolytic solution between the electrodes may be, for example, ensured by a mechnical stirrer or by forced circulation, for example by means of a pump.

During electrolysis, the active surface of the sacrificial electrode facing the active surface of the other electrode is dissolved. Therefore, the sacrificial electrode lowers gradually, by gravity, under the simple influence of its own weight. Furthermore, as the dissolution is more intense at the points closest to the unsacrificial electrode, the sacrificial electrode has a tendency to adapt itself closely to the shape of the unsacrificial electrode, which reduces the risks of irregular dissolution.

BRIEF DESCRIPTION OF THE DRAWINGS

The following description of three particular embodiments of the invention illustrate the invention, without limiting it.

DESCRIPTION OF THE PREFERRED EMBODIMENTS

Figure 1:
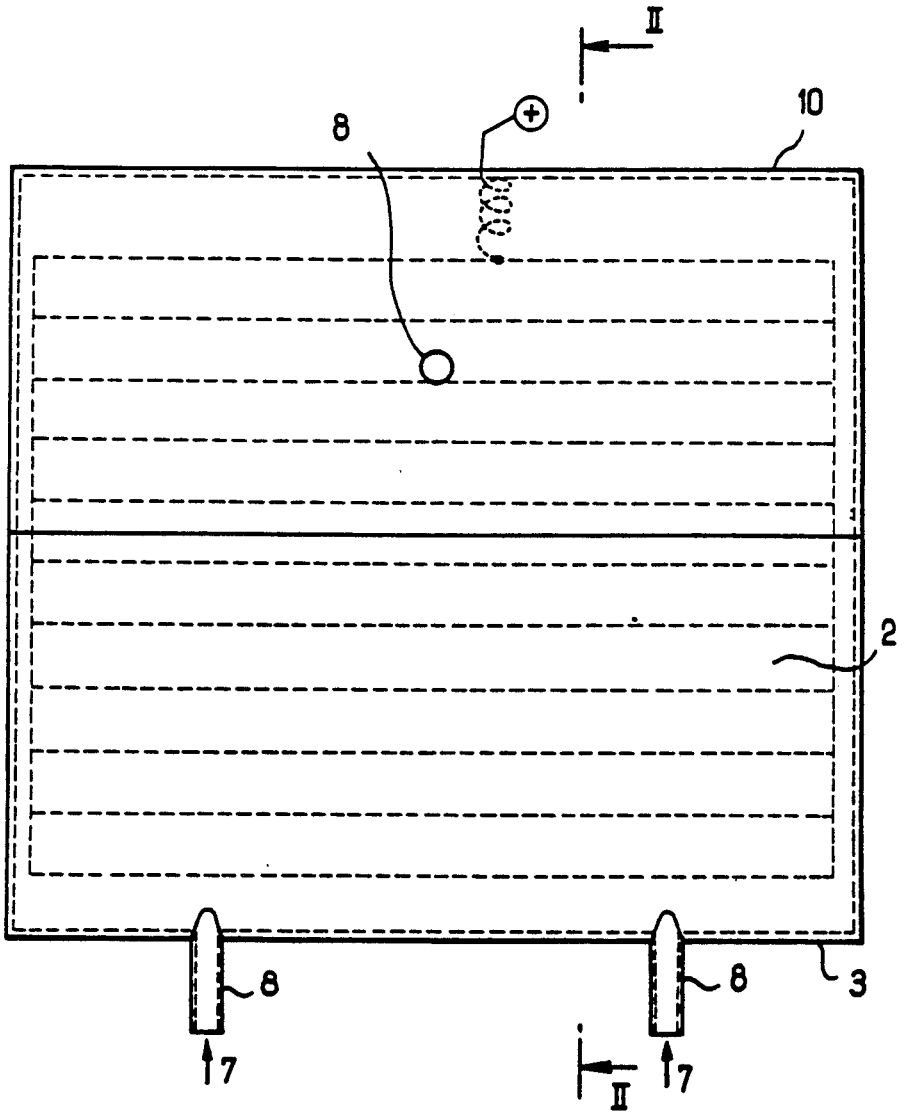
FIG. 1 represents a front view of a first embodiment of an electrolysis cell according to the invention.
Figure 2:
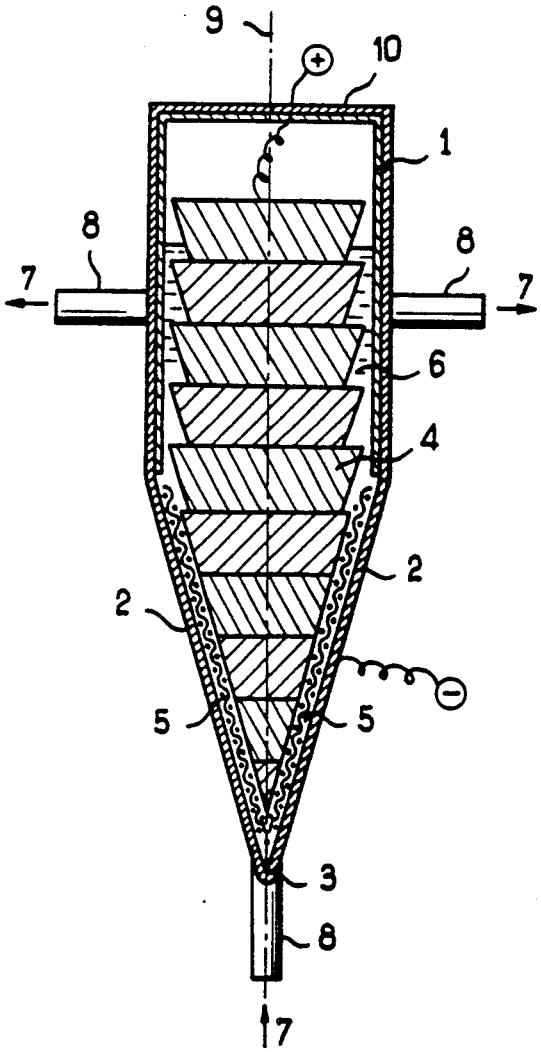
FIG. 2 represents, in cross-section along the line II—II, the cell represented in FIG. 1.

The electrolysis cell represented in FIGS. 1 and 2 comprises a tank of which one of the sides consists of the unsacrificial cathode 2. The active surface of the unsacrificial electrode 2 consists of two rectangular surfaces, of similar dimensions, arranged in the form of a dihedron of which the horizontal edge 3 forms the lowest part of the tank.

This active surface has, at all its points, a constant inclination of 17 degrees relative to the direction 9, which is the vertical direction and which may, for example, be marked by the vertical of the cutting plane along II—II passing through the edge 3.

The other sides of the tank are vertical sides passing through the edges of the cathode 2 other than the abovementioned edge 3 on the one hand, and a horizontal side 10 covering the tank at its upper part on the other. All these sides, other than those forming the cathode 2, are made of an electrical insulating material or internally coated with an electrical insulator 1, for example a paint or any other electrically insulating coat.

The anode 4 consists of a stacking of solid metal ingots of trapezoidal cross-section. Each layer of the stacking contains only a single ingot. The dimensions (length and width) of the ingots are slightly smaller than those of the tank.

Any straight line in direction 9 passing through any point on the sacrificial anode 4 passes through the active surface of the unsacrificial cathode 2.

The anode 4 is applied under the sole influence of its own weight against the cathode 2, which, alone, ensures the retention of the anode 4.

Figure 6:
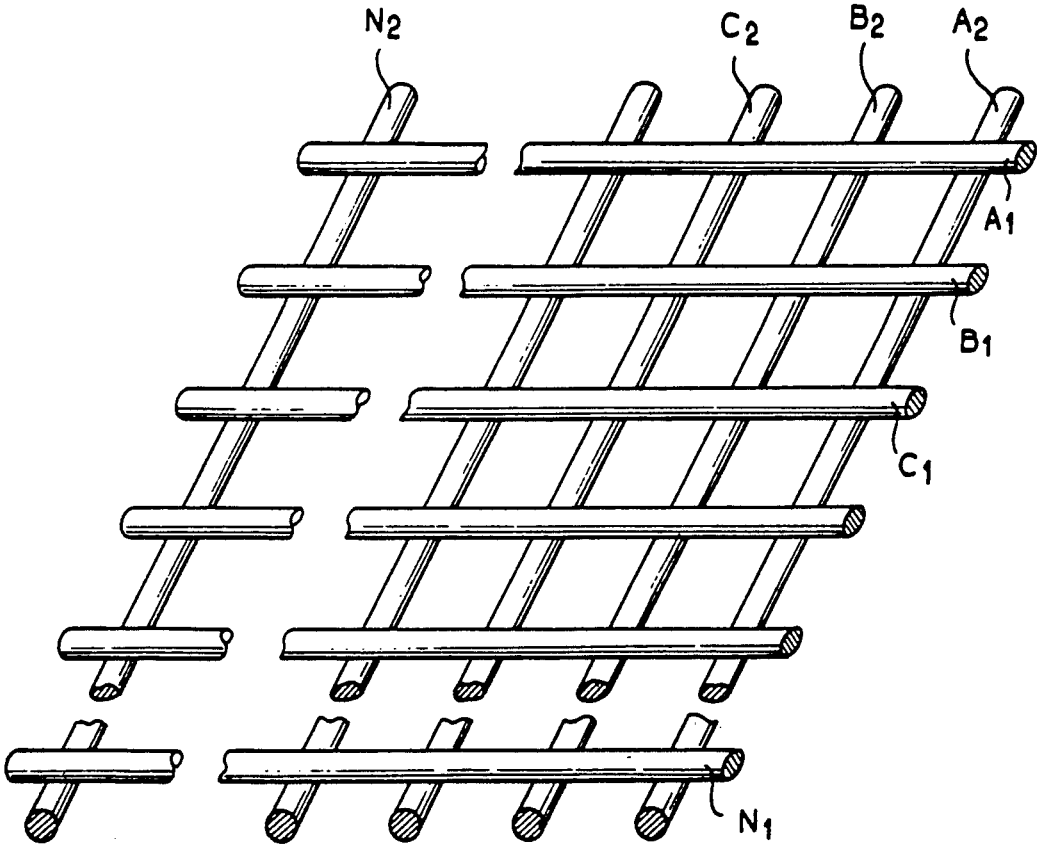
FIG. 6 represents a perspective view of a plastic material in the form of a grid which can be used as the electrical insulating material between the two electrodes.

The anode 4 and the cathode 2 are separated by a plastic material 5 in the form of a grid. FIG. 6 represents a perspective view thereof. The grid consists of two networks of parallel wires $A_1B_1C_1 \ldots N_1$on the one hand and $A_2B_2C_2 \ldots N_2$on the other. The wires of these two networks are cylindrical, or 1 mm diameter. The distance between the wires is 1 cm.

The two networks are superimposed, crossed at right angles and soldered at the points of contact between the wires.

The electrolytic solution 6 circulates upwards in the cell. Ducts 8 provide for the entry and the exit of this solution 16, in the direction of the arrows 7.

The electrodes 2 and 4 are supplied with electric current by a source of direct current, not represented in FIGS. 1 and 2.

When the cell is swivelled round the edge 3 by an angle alpha, the direction 9 becomes a direction D which forms an angle alpha with the vertical direction; the active surface of the unsacrificial electrode 2 still has at all its points a constant inclination of 17 degrees relative to this direction D and any straight line of direction D passing through any point on the sacrificial anode 4 passes through the active surface of the unsacrificial cathode 2. First of all, alpha must be less than 45 degrees in the context of the present invention. Furthermore, relative to the vertical, the inclination of the active surface of the electrode 2 is (17+alpha) for one of the rectangular surfaces and |17+alpha| for one which is |17+or−alpha|. In the context of the present invention, this inclination |17+or−alpha| relative to the vertical must be less than 45 degrees, i.e. for this particular embodiment, alpha must be less than 28 degrees. If this is not the case, significant anomalies in the functioning of the cell, especially with regard to the movement of the sacrificial electrode, may be noticed.

Figure 3:
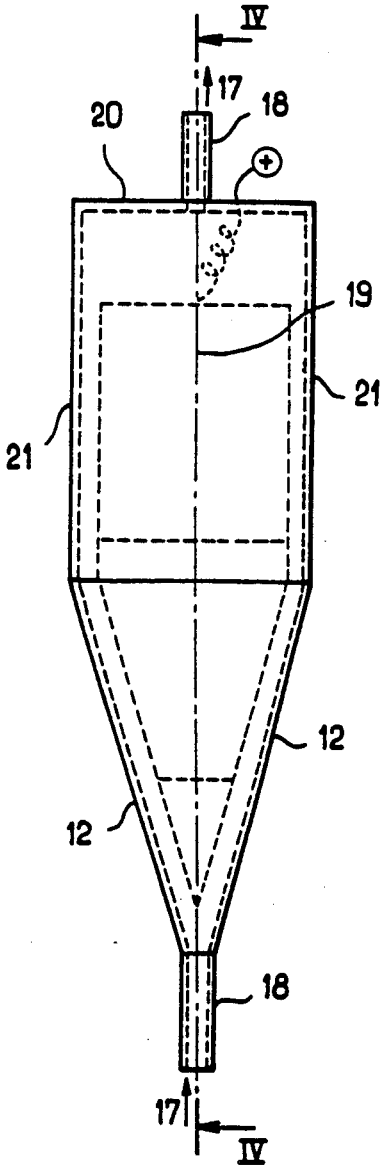
FIG. 3 represents a front view of a second embodiment of an electrolysis cell according to the invention.
Figure 4:
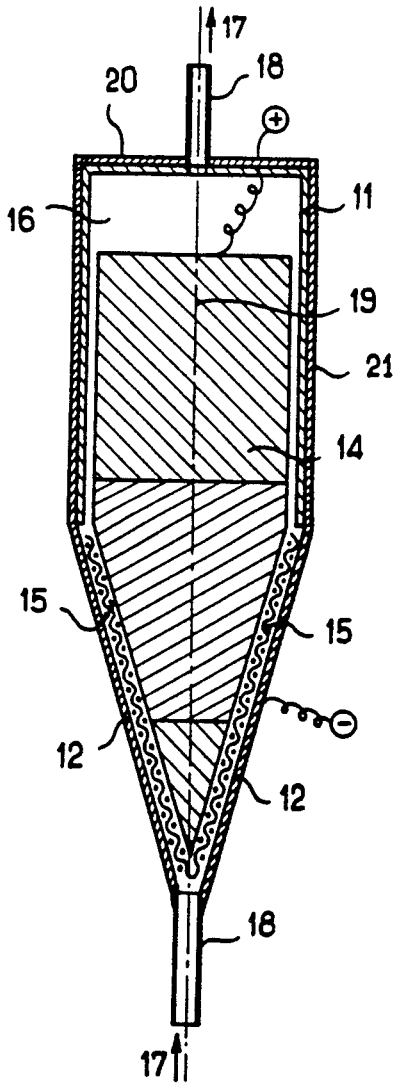
FIG. 4 represents, in cross-section along IV—IV, the cell represented in FIG. 3.

The electrolysis cell represented in FIGS. 3 and 4 comprises a tank of which the lower side consists of the unsacrificial cathode 12. The active surface of the unsacrificial electrode 12 is conical, the apex of the cone pointing downwards. This active surface has, at all its points, a constant inclination of 15 degrees relative to the direction 19 which is that of the axis of the cone. For the cell represented in FIGS. 3 and 4, this axis is vertical.

The upper side 21 of the tank is cylindrical and extends the cone in such a way that the cylinder and the cone have the same axis, the diameter of the cylinder being the same as that of the circle at the base of the cone.

A circular horizontal side 20, of diameter equal to that of the cylinder, covers the tank at its upper part.

The sides 20 and 21 are made of an electrical insulating material or internally coated with an electrical insulator 11, for example a paint or any other electrically insulating coat.

The anode 14 consists of a stacking of cylindrical solid metal ingots of which the diameter is slightly smaller than that of the cylindrical side 21 of the tank. It is applied under the sole influence of its own weight against the cathode 12 which, alone, ensures the retention of the anode 14.

Any straight line in direction 19 passing through any point on the sacrificial anode 14 passes through the active surface of the unsacrificial cathode 12.

The anode 14 and the cathode 12 are separated by a plastic material 15 in the form of a grid such as that represented in FIG. 6 and described previously.

The electrolytic solution 16 circulates upwards in the cell. Ducts 18 provide for the entry and the exit of this solution 16, in the direction of the arrows 17.

The inlet duct extends the tip of the cathode 12 along the axis of the cell. The electrodes 12 and 14 are supplied with electric current by a direct current source, not represented in FIGS. 3 and 4.

When the axis of the cell is swivelled by an angle alpha around the apex of the cone, the active surface of the unsacrificial electrode 12 still has, at all its points, a constant inclination of 15 degrees relative to the direction D represented by the axis of the cell and any straight line in direction D passing through any point on the sacrificial anode 14 passes through the active surface of the unsacrificial cathode 12. First of all, alpha must be less than 45 degrees in the context of the present invention. Furthermore, relative to the vertical, the inclination of the active surface of the unsacrificial electrode 12 is between (15+alpha) and |15−alpha|.

In the context of the present invention, the inclination relative to the vertical must be less than 45 degrees, i.e. for this particular embodiment, alpha must be less than 30 degrees. If this is not the case, significant anomalies may be noticed in the functioning of the cell.

Figure 5:
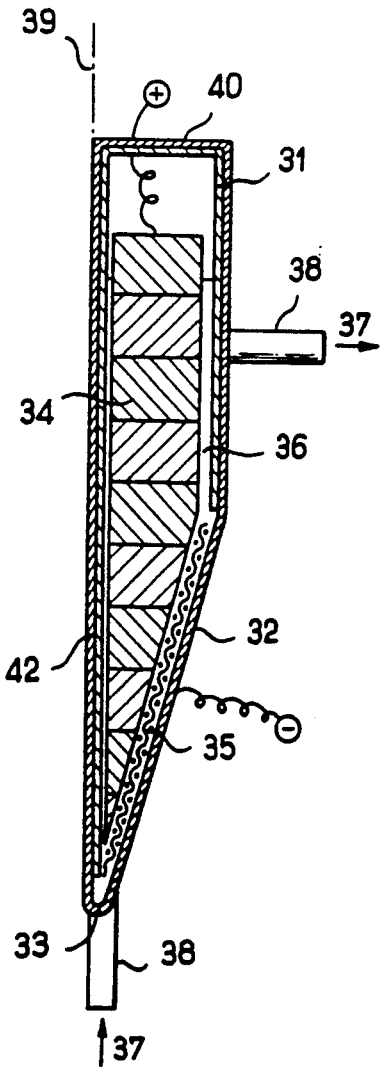
FIG. 5 represents a cross-sectional view of a third embodiment of an electrolysis cell according to the invention.

The electrolysis cell represented in FIG. 5 comprises a tank of which one of the sides consists of the unsacrificial cathode 32. The active surface of the cathode 32 is a rectangular surface, of which one of the sides 33 is horizontal and forms the lowest part of the tank. This active surface has, at all its points, a constant inclination of 20 degrees relative to the direction 39 which is the vertical direction which may be, for example, marked by the vertical of the cutting plane passing through the side 33.

The other sides of the tank are vertical sides passing through the 4 sides of the rectangular cathode 32 on the one hand, and a horizontal side 40 covering the tank at its upper part on the other. All these sides, other than that forming the cathode 32, are made of an electrical insulating material or internally coated with an electrical insulator 31, for example a paint or any other electrically insulating coat.

The anode 34 consists of a stacking of solid metal ingots of rectangular cross-section. Each layer of the stacking contains only a single ingot.

The dimensions (length and width) of the ingots are slightly smaller than those of the tank.

The anode 34 is applied under the sole influence of its own weight against the cathode 32 and against the side 42 of the tank which passes through the side 33 and which forms a dihedron with the cathode 32.

Any straight line in direction 39 passing through any point of the sacrificial anode 34 passes through the active surface of the unsacrificial cathode 32.

The anode 34 and the cathode 32 are separated by a plastic material 35 in the form of a grid such as that represented in FIG. 6 and described previously.

The electrolytic solution 36 circulates upwards in the cell. Ducts 38 provide for the entry and the exit of this solution 36, in the direction of the arrows 37.

The electrodes 32 and 34 are supplied with electric current by a direct current source, not represented in FIG. 5.

When the cell is swivelled by an angle alpha around the side 33 which forms the lowest part of the tank, direction 39 becomes a direction D which forms an angle alpha with the vertical direction 39.

The active surface of the cathode 32 still, of course, has, at all its points, a constant inclination of 20 degrees relative to this direction D.

In the context of the present invention:

(1) D forms an angle less than 45 degrees with the vertical, alpha is therefore less than 45 degrees.

(2) The active surface of the cathode 32 has an inclination less than 45 degrees relative to the vertical.

In order to satisfy the whole of these two conditions, the cell may be swivelled by an angle alpha less than 25 degrees in the clockwise direction when facing FIG. 5, which is by an angle alpha less than 45 degrees in the opposite direction.

The upper sides 10, 20 and 40 of the electrolysis cells according to the invention are removable or have a removable part so as to allow the introduction of the solid metal blocks.

Figure 7:
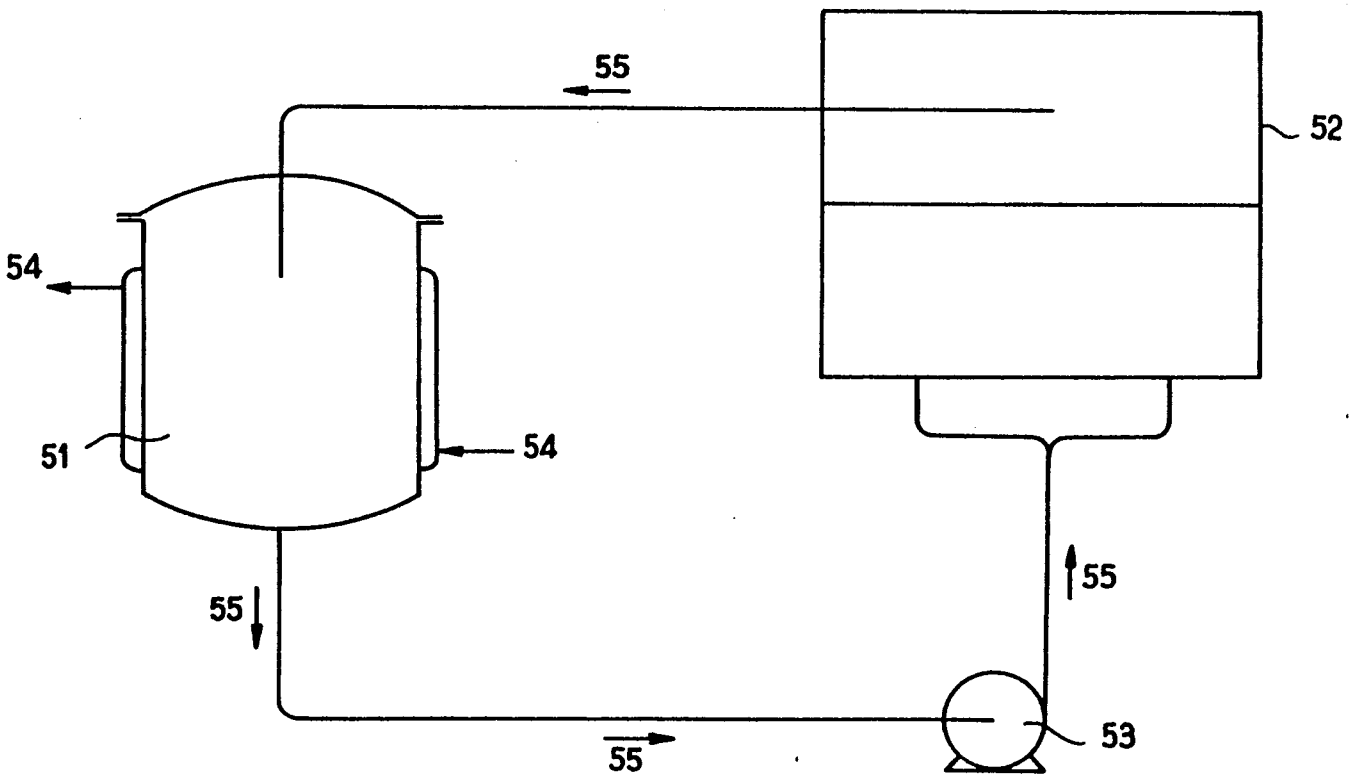
FIG. 7 represents a block diagram of a complete electrolysis outfit.

A complete outfit for the continuous electrolysis of a solution is represented diagrammatically in FIG. 7. It consists of a closed circuit comprising a double-walled reactor 51 which allows products to be loaded and recovered, an electrolysis cell 52 and a pump 53 which enables the electrolytic solution to be circulated in the circuit. The lower part of the reactor 51 is connected to the lower part (inlet) of the cell 52 and the outlet of the cell 52 is connected to the upper part of the reactor 51. The double-walled reactor 51 is cooled by a circulation of water, indicated by the arrows 54. The direction of circulation of the electrolytic solution defined previously is indicated by the arrows 55. The cell 52 shown diagrammatically in FIG. 7 is that represented in FIGS. 1 and 2.

The present invention also relates to the use of the new electrolysis cells described above, equipped with a sacrificial anode made of a metal chosen from the group consisting of magnesium, zinc, aluminum and their alloys for the electrosynthesis, in an organic medium, of organic compounds chosen from the group consisting of carboxylic acids, alcohols, ketones and aldehydes by the electrochemical reduction of organic halides.

According to a first variation, an electrolysis cell fitted with a sacrificial anode made of a metal chosen from the group consisting of magnesium and its alloys is used for the electrosynthesis of carboxylic acids by the electrochemical reduction of organic halides in the presence of carbon dioxide.

It was observed that, in a totally unexpected manner, very high yields are obtained with little or no by-products while the implementation is very simple and does not require the use of catalyst(s). This particular use applies to the electrosynthesis of a large number of aliphatic as well as aromatic carboxylic acids. As aliphatic chain, saturated or unsaturated, substituted or unsubstituted, alkyl or cycloalkyl chains containing from 1 to 21 carbon atoms may, for example, be mentioned.

As aromatic chains, there may be mentioned, for example, phenyl, thiophene, furan and pyridine rings, which may be substituted or unsubstituted. The carboxyl group may be linked to an aliphatic carbon atom or to a carbon atom of an aromatic ring.

The use of a magnesium anode gives the best results. In particular, trials were carried out with an anode made of either aluminum or zinc, all other conditions being identical. The yields are then lower than those obtained with the magnesium anode. The organic solvents used are only slightly protic solvents which are commonly used in organic electrochemistry, such as hexamethylphosphorotriamide (HMPT), tetrahydrofuran (THF), N-methylpyrrolidone (NMP) and dimethylformamide (DMF).

The organic solvent typically contains a supporting electrolyte such as tetrabutylammonium tetrafluoroborate ($BF_4NBu_4$) or lithium perchlorate.

The yields obtained for the carboxylate formed are high, very often greater than 99%. The yields of carboxylic acid isolated vary from 70 to 90% of the yield of the carboxylate formed.

According to a second variation, an electrolysis cell fitted with a sacrificial anode made of a metal chosen from the group consisting of magnesium, zinc, aluminum and their alloys is used for the electrosynthesis of alcohols, by the electrochemical reduction of organic halides which have a carbanion-stabilizing functional group or atom bound to the halogen-carrying carbon atom, in the presence of carbonyl derivatives.

These latter may be aldehydes as well as ketones; the yields are high and the implementation relatively simple.

The organic halides have at least one carbanion-stabilizing functional group or atom bound to the halogen-carrying carbon atom, i.e. situated in the alpha position relative to the halogen.

The carbanion-stabilizing functional groups and atoms are well known to the person skilled in the art. For example, halogens and ester, ketone, allyl, benzene, alkoxy and nitrile groups may be mentioned.

Preferably, the organic halides which can be used in the context of the present invention correspond to the general formula RX in which X represents a halogen atom and R represents:

a substituted or unsubstituted benzyl group

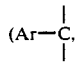

Ar representing an aromatic group)

a substituted or unsubstituted allyl group

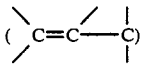

an alpha-monohalogenated

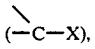

alpha-dihalogenated

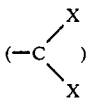

or alpha-trihalogenated ($CX_3$) group an alpha-ester group

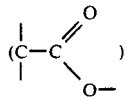

an alpha-ketone group

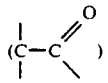

In an illustrative and non-limiting way, there may be mentioned, for example, benzyl chloride, benzyl bromide, allyl chloride, 3-chloro-2-methylpropene, 3-chloro-1-butene, ethyl 1-chloro-1-methyl acetate, carbon tetrachloride, dichlorophenylmethane, 1-phenyl-3-chloropropene and 1-methyl-3-chloropropene.

According to a particular embodiment, the carbonyl derivatives correspond to the general formula

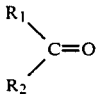

in which $R_1$ and $R_2$, which may be identical or different, represent:

a hydrogen atom, a saturated or unsaturated, substituted or unsubstituted aliphatic or cycloaliphatic chain, a substituted or unsubstituted aryl group, or alternatively, $R_1$ and $R_2$, together with the carbon atom to which they are attached, form a substituted or unsubstituted, saturated or unsaturated ring, optionally containing one or more hetero atoms such as nitrogen, oxygen, phosphorus or sulphur. In an illustrative and non-limiting way, there may be mentioned, for example, acetone, cyclohexanone, methyl ethyl ketone, acetaldehyde, benzophenone and dichlorobenzophenone.

According to a preferred variation, the alcohols obtained according to the process forming the subject of the present invention correspond to the general formula

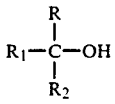

in which R, $R_1$ and $R_2$ have the meaning mentioned above. In a particularly preferred way, when the carbonyl derivatives are ketones, i.e. when $R_1$ and $R_2$ are other than hydrogen, tertiary alcohols are obtained.

As a general rule, in order to carry out the present invention, it is obvious to the person skilled in the art that the carbonyl derivative must be reducible with greater difficulty than the organic halide and none of the substituents carried by $R_1$ and $R_2$ must be more electrophilic than the carbonyl group itself.

The organic solvents and the supporting electrolytes used are the same as those mentioned above for the synthesis of carboxylic acids. DMF is preferably used as the solvent and the electrolysis is conducted at a temperature of between −20° C. and +30° C.

According to a third variation, an electrolysis cell fitted with a sacrificial anode made of a metal chosen from the group consisting of magnesium, zinc, aluminum and their alloys is used for the electrosynthesis of ketones and aldehydes by the electrochemical reduction of organic halides in the presence of organic acid anhydrides. The implementation is simple and the mass and faradic yields high.

According to a particular embodiment, the organic halides correspond to the general formula $R_3X$ in which X represents a halogen chosen from the group consisting of chlorine, bromine and iodine and $R_3$represents:

- a saturated or unsaturated, substituted or unsubstituted aliphatic or cycloaliphatic chain,
- a substituted or unsubstituted aryl group,
- a substituted or unsubstituted aromatic heterocycle, such as, for example, the thiophene, furan or pyridine ring.

Preferably, $R_3$represents an aliphatic chain substituted with at least one aromatic group such as, for example, in benzyl chloride, benzyl bromide, 1-phenyl-1-chloroethane and 1-phenyl-1-chloropropane.

In general, $R_3$may carry groups which are non-electroreducible or reducible with greater difficulty than the bond $R_3$—X, under the experimental conditions of the electrosynthesis. Such non-electroreducible groups are, for example, cyano, ether, sulphide or ester groups.

According to another particular embodiment, the organic acid anhydrides correspond to the general formula

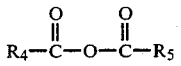

in which, $R_4$ represents:

- a hydrogen atom,
- a saturated or unsaturated, substituted or unsubstituted, aliphatic or cycloaliphatic chain,
- a substituted or unsubstituted aryl group, or
- a substituted or unsubstituted aromatic heterocycle such as, for example, the furan, thiophene or pyridine ring, and $R_5$represents:

- a saturated or unsaturated, substituted or unsubstituted aliphatic or cycloaliphatic chain,
- a substituted or unsubstituted aryl group,
- a substituted or unsubstituted aromatic heterocycle such as, for example, the furan, thiophene or pyridine ring, or
- an $OR_6$group in which $R_6$represents:
  - a saturated or unsaturated, substituted or unsubstituted aliphatic or cycloaliphatic chain,
  - a substituted or unsubstituted aryl group,
  - a substituted or unsubstituted aromatic heterocycle such as, for example, the furan, thiophene or pyridine ring,
  - or alternatively, $R_4$and $R_5$at least form a substituted or unsubstituted ring, as, for example, in the case of phthalic anhydride or succinic anhydride.

When $R_5$represents an $OR_6$group, the corresponding anhydrides are then mixed anhydrides of carboxylic acids and carbonic acid. In the remaining cases, these are carboxylic acid anhydrides.

When $R_4$represents a hydrogen atom, aldehydes are obtained. In this case, when the organic halides correspond to the general formula $R_3X$ defined above, the aldehydes obtained correspond to the general formula $R_3CHO$. In the remaining cases, when $R_4$does not represent a hydrogen atom, ketones are obtained. These ketones correspond to the general formula

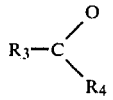

when the organic halides correspond to the general formula:

$R_3X$

In general, $R_4$and $R_5$may carry groups which are non-electroreducible, or reducible with greater difficulty than the bond $R_3$—X, under the experimental conditions of the electrosynthesis, and none of the groups carried by $R_3$or $R_4$must be more electrophilic than the anhydride group itself.

Preferably, $R_4$and $R_5$represent a straight-chain or branched alkyl chain.

Also preferably, $R_4$and $R_5$are identical.

In a particularly preferable way, $R_4$and $R_5$are identical and represent a straight-chain or branched alkyl chain, such as, for example, in the case of acetic anhydride.

The organic solvents and the supporting electrolytes used are the same as those mentioned above for the synthesis of carboxylic acids. Preferably, DMF is used as the solvent.

As a general rule, during the use of an electrolysis cell according to the invention for the electrosynthesis, in an organic medium, of organic or organometallic compounds and especially for the electrosynthesis of the organic derivatives mentioned above, the direction D is preferably the vertical direction.

The following examples illustrate the invention without limiting it.

EXAMPLE 1

Synthesis of phenylacetic acid

An electrolysis cell such as that represented in FIGS. 1 and 2 is used. The cathode, made of stainless steel, has an active surface area of 20 $dm^2$. The remaining sides of the tank are also made of stainless steel but are internally coated with an electrically insulating paint.

The anode 4 consists of a stacking of solid magnesium ingots. These ingots have the following dimensions: length: 360 mm, upper width: 130 mm, lower width: 120 mm, height: 50 mm.

The plastic material 5 in the form of a grid, is a polypropylene. This grid is just placed on the active surface of the cathode 2 of which it adapts itself to the shape, before introducing the anode 4. The complete outfit is as shown diagrammatically in FIG. 7.

For the first electrolysis, the three lower ingots are machined so as to adapt best to the dihedral shape of the cathode. The rest of the ingots are then stacked on these until the top of the cell. After mixing 3 kg of benzyl chloride (23.7 mol), 300 g of tetrabutylammonium fluoroborate and 27 l of anhydrous NMP in the reactor and applying a carbon dioxide pressure of 4 bar in the outfit, the solution thus obtained is circulated in the outfit and especially in the electrolysis cell. A constant intensity of 60 A is used for 24 hours. During the electrolysis, the voltage becomes stable rapidly at approximately 12 volts, which demonstrates the satisfactory functioning of the cell, viz. especially that the active surfaces of the two electrodes remain parallel with a constant gap. At the end of the electrolysis, the phenylacetic acid formed is isolated, and identified according to the usual methods well known to the person skilled in the art.

By weighing the anode twice, a weight loss of 590 g was measured.

The acid formed was isolated after extraction with ether followed by evaporation. The phenylacetic acid was identified by its melting point (76° C. ) and by its NMR and IR spectra. The yield of the isolated product obtained is 90% relative to the initial benzyl chloride.

In order subsequently to carry out other electrolyses, a few ingots may be added, before or during the electrolysis, on the remaining stacking so as to compensate for those which were consumed during the first electrolysis. For these other electrolyses, the optimum operating conditions are set right from the beginning of the electrolysis because the anode is then already in the optimum position relative to the cathode.

EXAMPLE 2

Synthesis of dimethylbenzylcarbional

An electrolysis cell such as that represented in FIGS. 1 and 2 is used. The cathode 2, made of nickel, has an active surface area of 1 $dm^2$. The remaining sides of the tank are made of stainless steel and are internally coated with an electrically insulating paint 1. The anode 4 consists of a stacking of cubical (of 50 mm side) aluminum blocks.

The plastic material 5 and the outfit are the same as those in Example 1. For the first electrolysis, the lower aluminum block was machined so that its perpendicular cross-section is trapezoidal and can thus, when it is wedged horizontally on the upper part of the cathode, has, right from the beginning of the electrolysis, a larger active surface area. The remaining cubes are not machined and are stacked on the first until the top of the cell. After mixing 200 g of benzyl chloride (1.58 mol), 20 g of tetrabutylammonium iodide, 280 g of DMF and 1500 g of acetone in the reactor, the solution thus obtained is circulated in the outfit.

For the first electrolysis, to start with, a constant intensity of 1 A is used. When the lower aluminum block reaches the bottom of the cell, a constant intensity of 2.5 A is maintained. The electrolytic voltage then remains stable, at approximately 15 V, which demonstrates the satisfactory functioning of the cell. The electrolysis is stopped after 42 h.

After stopping the electrolysis, the dimethylbenzylcarbinol formed is isolated, and identified according to the usual methods well known to the person skilled in the art. The alcohol formed was isolated after hydrolysis of the solution by means of an aqueous solution of ammonium chloride and extraction with ether. After evaporating the ether, the crude alcohol was purified by distillation. The pure alcohol thus isolated (purity checked by GC) is identified by its NMR and IR spectra. The yield of distilled dimethylbenzylcarbinol thus obtained is 56% (purity greate than 95%).

In order to then carry out other electrolyses, the current intensity is fixed at 2.5 A right from the beginning as the optimum operating conditions are then already set, the anode being in the optimum position relative to the cathode.

EXAMPLE 3 Synthesis of Dimethylbenzylcarbinol

The same trial as that in Example 2 is carried out, but without machining the lower block of the anode. The same result is obtained but it takes longer to reach the balance of operation.

EXAMPLE 4

Synthesis of Dimethylbenzylcarbinol

An electrolysis cell such as that represented in FIGS. 3 and 4 is used. The cathode 12, made of stainless steel, is a cone of 100-mm height and of 53-mm base diameter. The remaining sides of the tank are made of stainless steel and are internally coated with an inert and electrically insulating coat 11. The anode 14 consists of a stacking of cylindrical aluminum blocks of 50 mm diameter and 100 mm height. The plastic material 15 and the outfit are the same as those in Example 1. For the first electrolysis, the lower aluminum block was machined so that it is approximately in the form of a cone of 100-mm height and of 50-mm base diameter, which is easily obtained using a cylindrical block which has these dimensions.

After positioning the plastic material 15 in the form of a grid on the active surface of the cathode, the machined block which adapts itself to the shape of the cathode is introduced, several other blocks are then stacked on this lower block up to the top of the cell.

The electrolysis is then carried out under the same conditions as in Example 2. The electrolytic voltage becomes stable very quickly, due to the machining of the first block. The yield of distilled dimethylbenzylcarbinol obtained is 60% (purity greater than 95%).

EXAMPLE 5

Synthesis of dimethylbenzylcarbinol

The same trial as that in Example 4 is carried out, but without machining the lower block before the first electrolysis. The same result is obtained but it takes much longer to reach the balance of operation.

EXAMPLE 6

Synthesis of dimethylbenzylcarbinol

The same trial as in Example 3 is carried out, with the sole exception that the anode 4 consists of a stacking of blocks of 50-mm length, 50-mm height and 25-mm width, each layer of the stacking consisting of 2 blocks placed side by side. Pure dimethylbenzylcarbinol is obtained with a yield of 53%.

EXAMPLE 7

Synthesis of dimethylbenzylcarbinol

An electrolysis cell such as that represented in FIG. 5 is used. The cathode 32, made of nickel, has an active surface area of 0.5 $dm^2$. The remaining sides of the tank are made of stainless steel and are internally coated with an electrically insulating paint 31.

The anode 34 consists of a stacking of aluminium blocks of 50-mm length, 50-mm height and 30-mm width. The plastic material 35 and the outfit are the same as those in Example 1. For the first electrolysis, the 2 lower blocks are machined so that their geometry is coupled with that of the dihedral lower part of the cell. Other unmachined blocks are then stacked on these 2 blocks, up to the top of the cell. The electrolysis is then carried out under the same conditions as those in Example 2.

Pure dimethylbenzylcarbinol is obtained with a yield of 51%.

In order to then carry out other electrolyses, it is then sufficient to add, if required, a few blocks through the top of the cell as the optimum operating conditions are already set, the anode being in the optimum position relative to the cathode.

EXAMPLES 8 to 23

Synthesis of various other organic acids

The following examples were carried out under the same general conditions as those in Example 1. The halogenated derivatives listed in Table I were used instead of benzyl chloride. Table I also gives the solvent used and the results obtained. The acids obtained were identified by IR and NMR spectrometries as well as using the melting point for some of them.

The yields of the acid isolated are expressed as % relative to the initial organic halide.

EXAMPLES 23 to 31

Synthesis of various other alcohols

The following examples were carried out under the same general conditions as those in Example 2.

Table II gives, for each example, the halogenated derivative and the carbonyl derivative used at the start, the nature of the solvent, of the electrolyte and of the electrodes, the temperature at which the electrolysis is carried out, the molar ratio between the two initial products, the number of Faraday per mole of organic halide, the yield of pure alcohol isolated expressed as % relative to the initial organic halide. The alcohols obtained were identified by IR and NMR spectrometries.

EXAMPLE 33

Synthesis of benzylmethylketone (phenylacetone)

An electrolysis cell such as that represented in FIGS. 1 and 2 is used. The cathode 2, made of nickel, has a surface area of 1 $dm^2$. The remaining sides of the tank are made of stainless steel and are internally coated with an electrically insulating paint.

The anode 4 consists of a stacking of cubical (of 50-mm side) magnesium blocks. The plastic material 5 and the outfit are the same as those in Example 1.

For the first electrolysis, the lower magnesium block was machined so that its perpendicular cross-section is trapezoidal. The other cubes are not machined and are stacked on the first up to the top of the cell.

After mixing 100 g of benzyl chloride (0.79 mol), 700 g of acetic anhydride (1.86 mol), 1100 g of DMF and 20 g of tetrabutylammonium fluoroborate in the reactor, the solution thus obtained is circulated in the outfit.

The electrolytic current intensity is 2A and the temperature 25° C. After electrolysis for 23 h (2.2 Faraday per mole of benzyl chloride) the DMF is evaporated and the residue is hydrolyzed with hot dilute HCL. The benzylmethylketone is isolated by extraction with ether, with a yield of 39%. The pure benzylmethylketone thus isolated was identified by IR and NMR spectra and its purity was checked by GC (>95%).

EXAMPLE 34

Synthesis of 4-tert-butylphenylacetone

The electrolysis is carried out as in Example 33 by replacing the benzyl chloride by 4-tert-butylphenylchloromethane.

The pure 4-tert-butylphenylacetone thus isolated (yield 73%) was identified by IR and NMR spectra and its purity was checked by GC (>95%).

EXAMPLE 35

Synthesis of 3,4-dimethoxyphenylacetone

The electrolysis is carried out as in Example 33 by replacing the benzyl chloride by 3,4-dimethoxyphenylchloromethane.

The pure 3,3-dimethoxyphenylacetone thus isolated (yield 25%) was identified by its IR and NMR spectra and its purity was checked by GC (>95%).

TABLE I

| Ex. | Organic halide | Solvent | Yield of the corresponding carboxylic acid isolated (in %) | Melting point of the acid isolated in °C. Experimental | Theoretical |
|---|---|---|---|---|---|
| 8 | p.Bromofluorobenzene | THF-HMPT | 85 | 184 | 185 |
| 9 | 1-Bromododecane | DMF | 50 | — | — |
| 10 | 1-Bromooctadecane | THF-HMPT | 41 | — | — |
| 11 | Chlorobenzene | DMF | 54 | — | — |
| 12 | 2-Chlorothiophene | THF-HMPT | 80 | 126 | 129 |
| 13 | 3-Bromofuran | " | 78 | 121 | 122–123 |
| 14 | β-Bromostyrene (mixture of cis and trans isomers) | " | 80 | 106 | trans: 135 cis: 42–56 |
| 15 | p.Bromoacetophenone | " | 82 | 206 | 210 |
| 16 | 1-Bromodecane | " | 75 | 28 | 28.6 |
| 17 | 1-Chloroethylbenzene (phenethyl chloride) | " | 80 | not measured | not listed |
| 18 | 3-chloro-1-phenylpropene | " | 85 | 85 | 87 |
| 19 | Monochloroacetone | DMF | 82 | — | — |
| 20 | Ethyl chloroacetate | THF | 80 | — | — |
| 21 | Bromobenzene | DMF | 85 | 122 | 122.4 |
| 22 | 1,3-dichloroacetone | DMF | 80 | — | — |
| 23 | 1,2-dichloroacetone | DMF | 82 | — | — |

TABLE II

| Example | Organic halide | Carbonyl derivative | Molar ratio carbonyl derivative / halide | Solvent | Electrolyte | Anode | Cathode | Temperature of the bath (°C.) | Number of F per mole of organic halide | Current density on the cathode (A/dm2) | Alcohol formed | Yield (%) |
|---|---|---|---|---|---|---|---|---|---|---|---|---|
| 24 | 3-chloro 2 methyl propene $CH_2{=}C(CH_3){-}CH_2Cl$ | cyclo-hexanone | 3.2 | DMF | $N(Bu)_4I$ | Duralumin | Ni | −20 | 2 | | 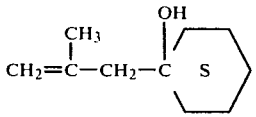 | 20 |
| 25 | 3-chloro 2 methyl propene | acetone | 11.3 | Acetone DMF 80/20 | $N(Bu)_4I$ | Duralumin | Ni | −20 | 2.5 | | 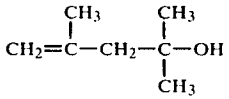 | 95 |
| 26 | 3-chloro 2 methyl propene | benzal-dehyde | 5 | DMF | $N(Bu)_4I$ | Al | C | −10 | 3.5 | | 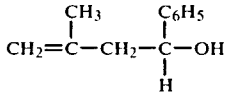 | 70 |
| 27 | ethyl 2-chloropropionate | acetone | 9 | Acetone DMF 80/20 | $N(Bu)_4I$ | Mg | C | −20 | 2.5 | | 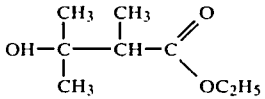 | 42 |
| 28 | $CCl_4$ | acetone | 9 | Acetone DMF 80/20 | $N(Bu)_4I$ | Mg | C | −20 | 2 | | 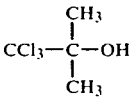 | 45 |
| 29 | $CCl_4$ | Benzal-dehyde | 4.3 | DMF | $N(Bu)_4I$ | Mg | C | −10 | | 2 | 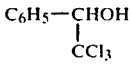 | 60 |
| 30 | 3-chloro 1 methyl propene $CH_3{-}CH{=}CH{-}CH_2Cl$ | acetone | 10.4 | acetone DMF 80/20 | $N(Bu)_4I$ | Duralumin | Ni | −10 | | 2 | 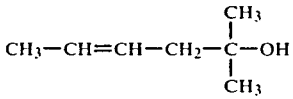 | cis: 11 trans: 20 |
| | | | | | | | | | | | 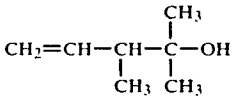 | 68 |
| 31 | 3-chloro 1 butene $CH_2{=}CH{-}CH(Cl){-}CH_3$ | acetone | 10.6 | acetone DMF 80/20 | $N(Bu)_4I$ | Duralumin | Ni | −10 | | 2 | 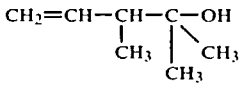 | 53 |

TABLE II-continued

| Example | Organic halide | Carbonyl derivative | Molar ratio carbonyl derivative / halide | Solvent | Electrolyte | Anode | Cathode | Temperature of the bath (°C.) | Number of F per mole of organic halide | Current density on the cathode (A/dm2) | Alcohol formed | Yield (%) |
|---|---|---|---|---|---|---|---|---|---|---|---|---|
| | | | | | | | | | | | $CH_3-CH=CH-CH_2-C(CH_3)_2-OH$ | cis: 12<br>trans: 34 |
| 32 | benzyl chloride $C_6H_5CH_2Cl$ | methyl-ethyl-ketone | 7.3 | DMF | $N(Bu)_4BF_4$ | Mg | stainless steel | +6 | | 2 | $C_6H_5-CH_2-C(CH_3)(C_2H_5)-OH$ | 50 |

I claim:

1. A method for electrosynthesis of organic compounds chosen from the group consisting of aliphatic carboxylic acids, aromatic carboxylic acids, alcohols, ketones and aldehydes in an organic medium, comprising the steps of:

circulating organic halides having at least one carbanion-stabilizing functional group or atom bound to the halogen-carrying carbon atom through an electrolysis cell having:

an unsacrificial electrode with a conical active surface with a constant inclination relative to a direction D forming an angle less than 45 degrees with the vertical on the one hand, and an inclination less than 45 degrees relative to the vertical on the other;

a sacrificial electrode made from a metal chosen from the group consisting of magnesium, zinc, aluminium and their alloys, which is consumed during electrode synthesis by the electrochemical reaction of which the sacrificial electrode forms the seat, having an active surface, having at least one solid metal block applied under the influence of its own weight against the unsacrificial electrode, any straight line passing through the sacrificial electrode in the direction D also passing through the active surface of the unsacrificial electrode;

an electrical insulating material separating the unsacrificial electrode and the sacrificial electrode while allowing passage of the organic halides through the electrical insulating material, having a shape and dimensions to enable the active surfaces of the two electrodes to remain parallel during electrosynthesis; and electrochemically reducing the organic halides as the organic halides circulate through the electrolysis cell.

2. A method according to claim 1 for the electrosynthesis of carboxylic acids by the electrochemical reduction of organic halides according to claim 1 including using carbon dioxide and a sacrificial electrode made of a metal chosen from the group consisting of magnesium and its alloys.

3. A method according to claim 1 for the electrosynthesis of alcohols by the electrochemical reduction of organic halides which have a carbanion-stabilizing functional group or atom bound to the halogen-carrying carbon atom in the presence of at least one carbonyl derivative including:

dissolving the organic halide and the at least one carbonyl derivative in an organic solvent; and using a sacrificial electrode made from a metal chosen from the group consisting of magnesium, aluminum, zinc and their alloys.

4. A method according to claim 1 for the electrosynthesis of ketones or aldehydes by the electrochemical reduction of at least one organic halide in the presence of at least one organic acid anhydride including:

dissolving the at least one organic halide and the at least one organic acid anhydride in an organic solvent; and using a sacrificial anode made of a metal chosen from the group consisting of magnesium, aluminum or zinc and their alloys and a nonsacrificial cathode.

5. Electrolysis cell for the electrosynthesis, in an organic medium, of organic or organometallic compounds, comprising:

an unsacrificial electrode having an active surface;

a sacrificial electrode which is sacrificed during the electrosynthesis by the electrochemical reaction of which it forms the seat, the sacrificial electrode having an active surface, and comprising at least one solid metal block applied under the influence of its own weight against the other unsacrificial electrode; and electrical insulating material which allows separating the unsacrificial electrode and the sacrificial electrode, while allowing passage of an electrolytic solution through the electrical insulating material, having a shape and dimensions to enable the active surfaces of the two electrodes to remain parallel during the electrosynthesis;

wherein the active surface of the unsacrificial electrode is conical having a constant inclination relative to a direction D forming an angle less than 45 degrees with the vertical on the one hand, and an inclination less than 45 degrees relative to the vertical on the other;

any straight line in direction D passing through any point of the sacrificial electrode passes through the active surface of the unsacrificial electrode.

6. Electrolysis cell according to claim 5 wherein the sacrificial electrode comprises layers of stacked solid metal blocks, each layer of the stacking containing only a single block.

7. Electrolysis cell according to claim 5 wherein the unsacrificial electrode is made of a metal chosen from the group consisting of nickel and stainless steel.

8. Electrolysis cell according to claim 5, wherein the distance between the active surfaces of the two electrodes is less than 5 mm.

9. Electrolysis cell according to claim 5 wherein the sacrificial electrode is applied against the other electrode under the influence, in addition to that of its own weight, of that of an inert load, which rests on the sacrificial electrode.

10. Electrolysis cell according to claim 9 wherein the inert load is an electricity conductor and serves for ensuring the electricity supply to the sacrificial electrode.

11. Electrolysis cell according to claim 1 wherein the sacrificial electrode is applied against the other electrode under the sole influence of its own weight.

12. Electrolysis cell according to claim 5 wherein the electrical insulating material is a plastic material in the form of a grid of which the thickness is less than 5 mm and the grid comprises two parallel wire networks, these two networks being superimposed, crossed and joined to each other at the points of contact between the wires, the thickness of the wires of each network being the same.

13. An electrolysis cell fitted with a sacrificial electrode made of a metal chosen from the group consisting of magnesium, zinc, aluminum and their alloys according to claim 5 for the electrosynthesis, in an organic solvent medium, of organic compounds chosen from the group consisting of carboxylic acids, alcohols, ketones and aldehydes, by the electrochemical reduction of organic halides.

14. An electrolysis cell according to claim 13 fitted with a sacrificial electrode made of a metal chosen from the group consisting of magnesium and its alloys for the electrosynthesis of carboxylic acids by the electrochemical reduction of organic halides in the presence of carbon dioxide.

15. An electrolysis cell according to claim 13 fitted with a sacrificial electrode made of a metal chosen from the group consisting of magnesium, aluminum, zinc and their alloys for the electrosynthesis of alcohols by the electrochemical reduction of organic halides which have a carbanion-stabilizing functional group or atom bound to the halogen-carrying carbon atom in the presence of carbonyl derivaties.

16. An electrolysis cell according to claim 13 fitted with a sacrificial electrode made of a metal chosen from the group consisting of magnesium, aluminum or zinc and their alloys for the electrosynthesis of ketones or aldehydes by the electrochemical reduction of organic halides in the presence of organic acid anhydrides.

* * * * *